US008307603B1

(12) United States Patent
Mitchell et al.

(10) Patent No.: US 8,307,603 B1
(45) Date of Patent: Nov. 13, 2012

(54) METHODS OF CONSTRUCTING STAIR UNIT

(75) Inventors: Steve A. Mitchell, Westminster, CO (US); Paul E. Sanders, Arvada, CO (US); Richard M. Vose, Northglenn, CO (US); William K. Henthorn, Muscatine, IA (US); Jonathan D. Mitchell, Westminster, CO (US)

(73) Assignee: Ascend Stair Company, Commerce City, CO (US)

( * ) Notice: Subject to any disclaimer, the term of this patent is extended or adjusted under 35 U.S.C. 154(b) by 82 days.

(21) Appl. No.: 12/780,128

(22) Filed: May 14, 2010

(51) Int. Cl.
*E04B 1/00* (2006.01)

(52) U.S. Cl. ..... 52/741.2; 52/188; 52/191

(58) Field of Classification Search ..... 52/741.2, 52/188, 191
See application file for complete search history.

(56) References Cited

U.S. PATENT DOCUMENTS

| | | | | |
|---|---|---|---|---|
| 1,848,085 | A | 3/1932 | Eisenschmiot | |
| 2,021,457 | A * | 11/1935 | MacKenzie | 52/191 |
| 3,393,481 | A * | 7/1968 | Meuret | 52/188 |
| 3,601,221 | A | 8/1971 | Fuentes | |
| D256,663 | S | 9/1980 | Gilb | |
| 4,464,870 | A | 8/1984 | Crepeau | |
| D285,773 | S | 9/1986 | Cappel | |
| 4,757,653 | A | 7/1988 | Anderholm | |
| 4,819,391 | A | 4/1989 | Tassin | |
| 4,823,529 | A | 4/1989 | Canfield | |
| 5,131,197 | A | 7/1992 | Varga | |
| D364,794 | S | 12/1995 | Eberschlag | |
| 5,636,483 | A | 6/1997 | Wille | |
| 5,778,610 | A | 7/1998 | Berg | |
| 6,354,403 | B1 | 3/2002 | Truckner | |
| 6,397,529 | B1 * | 6/2002 | Grenier | 52/182 |
| 6,438,909 | B2 | 8/2002 | Birch | |
| D492,889 | S | 7/2004 | Craine | |
| 6,758,016 | B2 | 7/2004 | Gobeil | |
| D500,666 | S | 1/2005 | Murphy | |
| 6,860,460 | B2 | 3/2005 | Rellergert | |
| D511,086 | S | 11/2005 | Craine | |
| D523,735 | S | 6/2006 | Craine | |
| D558,040 | S | 12/2007 | Skinner | |
| D558,041 | S | 12/2007 | Skinner | |
| D575,220 | S | 8/2008 | Pockalny | |
| D590,697 | S | 4/2009 | Townley | |

(Continued)

OTHER PUBLICATIONS

"EZ Stairs Composite Trimming and Cleat Installation;" http://www.ez-stairs.com/howitworks/composite.htm.

*Primary Examiner* — William Gilbert
*Assistant Examiner* — Gisele Ford
(74) *Attorney, Agent, or Firm* — Dan Shifrin

(57) ABSTRACT

Methods and tooling for constructing a stair unit are provided. The methods incorporate tooling and tables to create templates (two for each tread) that, when laid along a series of hypotenuse marks on the stringer from the table, will dictate the geometry, cutting, and fitting to the treads, without using a framing square. Brackets are used to conjoin the stringer, tread material, and tread framing so that the tread width is not limited by the lack of strength of the tread material. The methods then incorporate the bracket in a tread module to provide further convenience and sequencing options for the assembly of the stair unit. An alternate method combines aspects of the template and the bracket to hold continuous support for the tread, accomplishing a cut stringer look. The result is less time and material expense with better strength, fit and finish.

7 Claims, 18 Drawing Sheets

U.S. PATENT DOCUMENTS

| | | | | |
|---|---|---|---|---|
| D595,115 | S | 6/2009 | Royer | |
| D638,282 | S | 5/2011 | Robinson | |
| 7,946,085 | B2 * | 5/2011 | Prins | 52/191 |
| 7,954,249 | B1 * | 6/2011 | Perkey | 33/427 |
| 2002/0124492 | A1 | 9/2002 | Gobeil | |
| 2004/0104331 | A1 | 6/2004 | Rellergert | |
| 2005/0160688 | A1 | 7/2005 | Truckner | |
| 2008/0040992 | A1 | 2/2008 | Greenlee | |
| 2009/0205267 | A1 | 8/2009 | Prins | |
| 2011/0167740 | A1 | 7/2011 | Truckner | |

* cited by examiner

METHODS OF CONSTRUCTING STAIR UNIT

RELATED APPLICATION DATA

The present application is related to commonly-assigned and co-pending U.S. application Ser. No. 12/780,137, entitled BRACKET FOR CONSTRUCTING STAIR UNIT, filed on the filing date hereof, which application is incorporated herein by reference in its entirety.

TECHNICAL FIELD

The present invention relates generally to the construction of stairs and, in particular, to a bracket and more efficient, less complicated methods and tooling for constructing stairs, with particular applications for man-made materials.

BACKGROUND ART

Traditionally, flights of stairs have been constructed using two or more parallel notched stringers extending between an upper and lower surface. The builder determines the total rise of the flight of stairs, the rise needed for each tread and the number of treads. The stringers are marked with the aid of a framing square. Notches in each stringer are cut to facilitate the attachment of horizontal tread and vertical riser members, and the top and bottom of each stringer are cut at the appropriate angles. The stringers are attached in place, such as to the perimeter joist of a deck. The treads and riser members are then attached to, and extend between, the notches in the stringers.

Because notching a stringer reduces the physical strength of the lumber used for a stringer, it is no longer a "rated" member for bearing strength. Consequently, the member cannot be engineered because the load cannot be calculated except by a certified lumber rating professional. Also, the lumber used to make notched stringers must be significantly larger than would be required if the stringers were un-notched, or more of them must be used, to compensate for the weakness. Such construction increases the cost of stair construction.

Additionally, because of the varying floor space available for a given flight of stairs and because of the varying vertical distance between the lower and upper levels of buildings or decks, notched stringers cannot be mass-produced. Instead, they are generally custom-made at the construction site, adding further to the cost. Thus, the cost of building a flight of stairs has remained inordinately high. Practical problems have also been encountered in some cases because of inaccurate calculations, which may result in a riser having a different vertical dimension than that of the remaining risers or, in other cases, because of inaccurate notching of one stringer in a set of stringers. If the notches on a set of stringers are not precisely matched, the tread and riser members will not align properly and the resulting stair system may be weak and shoddy-looking.

More recently, brackets have been used to attach wooden stair treads to stringers (along lines made using a framing square). Even with brackets, however, determining the correct geometry for a particular flight of stairs, and then using the geometry to construct the stairs, remains difficult and leaves little room for error. Also, even with existing brackets, the span between stringers is limited by the structural ability of the wooden stair tread material.

The use of engineered materials, also known as man-made or composite materials in construction, such as for exterior decking, is becoming more common, especially because of their low maintenance requirements. However, a disadvantage of man-made materials for stair treads is that they are not strong enough to span the same distance as a natural wood tread and need support every 8 to 12 inches along the tread rather than every 16 to 24 inches for wood. Because the span between stringers is limited by the structural ability of the man-made stair tread material more stringers are required to support the weak tread material, again adding to the complexity of construction and its costs of time and materials. And, if the stringers are notched, they are weakened, as described above, which is another reason that more stringers would be required. Thus, even the use of conventional brackets does not affect the necessity for the additional stringers.

SUMMARY OF THE INVENTION

The drawbacks of prior stair building methods are addressed by the bracket and methods of the present invention, used together or separately. The geometry of a flight of stairs ("stair unit") is determined from a table based upon equations. Using the total height of the stair unit, the stair run (the horizontal distance between the nosing of each tread), and the stair rise (the height between the tops each stair tread), the table is consulted to obtain the number of treads in the stair unit and the hypotenuse and angles of a right triangle. A pair of triangular templates is then cut for each tread using the determined rise per tread, stair nosing off-set, and angles.

Beginning at the top of each of a pair of stringers, the starting point of the hypotenuse of each template triangle is marked using the numbers provided by the trigonometric table. The template triangles are laid along, and secured to, the inside of each stringer along the top edge, aligned with the marks. The ends of the stringers are then cut at appropriate angles, parallel and perpendicular to the bottom side of the template triangle. There is no use of a framing square or pencil marks along the tread or riser; the geometry is evident.

A stair bracket is provided having a flat, horizontal base to which at least one tread plank is securable and having a length less than tread run. The bracket also includes at least one pair of vertical flanges, each pair of flanges surrounding a generally U-shaped opening, each opening having dimensions to receive an end of a joist securable to one of the pairs of first vertical flanges within the opening. A second flange, orthogonal to the base and the at least one pair of first vertical flanges, is formed for securing the bracket to a stringer.

A pair of brackets is used to secure two (or more) tread or decking planks to the tread structure, which consists of two (or more) joists, to form a tread module. The brackets are then used to secure the tread module to the insides of the two stringers with the tops of the tread modules aligned with the bottoms of the template triangles with the nosing of the tread resting in the nosing relief (notch) of the adjacent template triangle. Other tread modules are constructed and secured to the stringers to assemble a complete stair unit.

In another method of constructing a stair unit, structural triangles are cut, using the same table as would be used to cut template triangles, from dimensional lumber or from adequate man-made material. Notches in the front edges of the structural triangles are cut and the triangles secured to the top edges of the stringers, along hypotenuse marks as in the first method. The ends of the stringers are then cut at appropriate angles, parallel and perpendicular to the top side of the template triangle. Again, there is no use of a framing square or pencil marks along the tread or riser; the geometry is evident. After the stringers are secured to a perimeter joist, the ends of a front joist are placed in the notches of opposing structural triangles to span the stringers. A rear joist is secured behind the front joist to the insides of the stringers, such as with common brackets and cross blocking may be secured between the joists. Tread planks are secured to the tops of the joists to complete the stair unit.

DETAILED DESCRIPTION OF THE PREFERRED EMBODIMENT

The described features, structures, or characteristics of the invention may be combined in any suitable manner in one or more embodiments. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
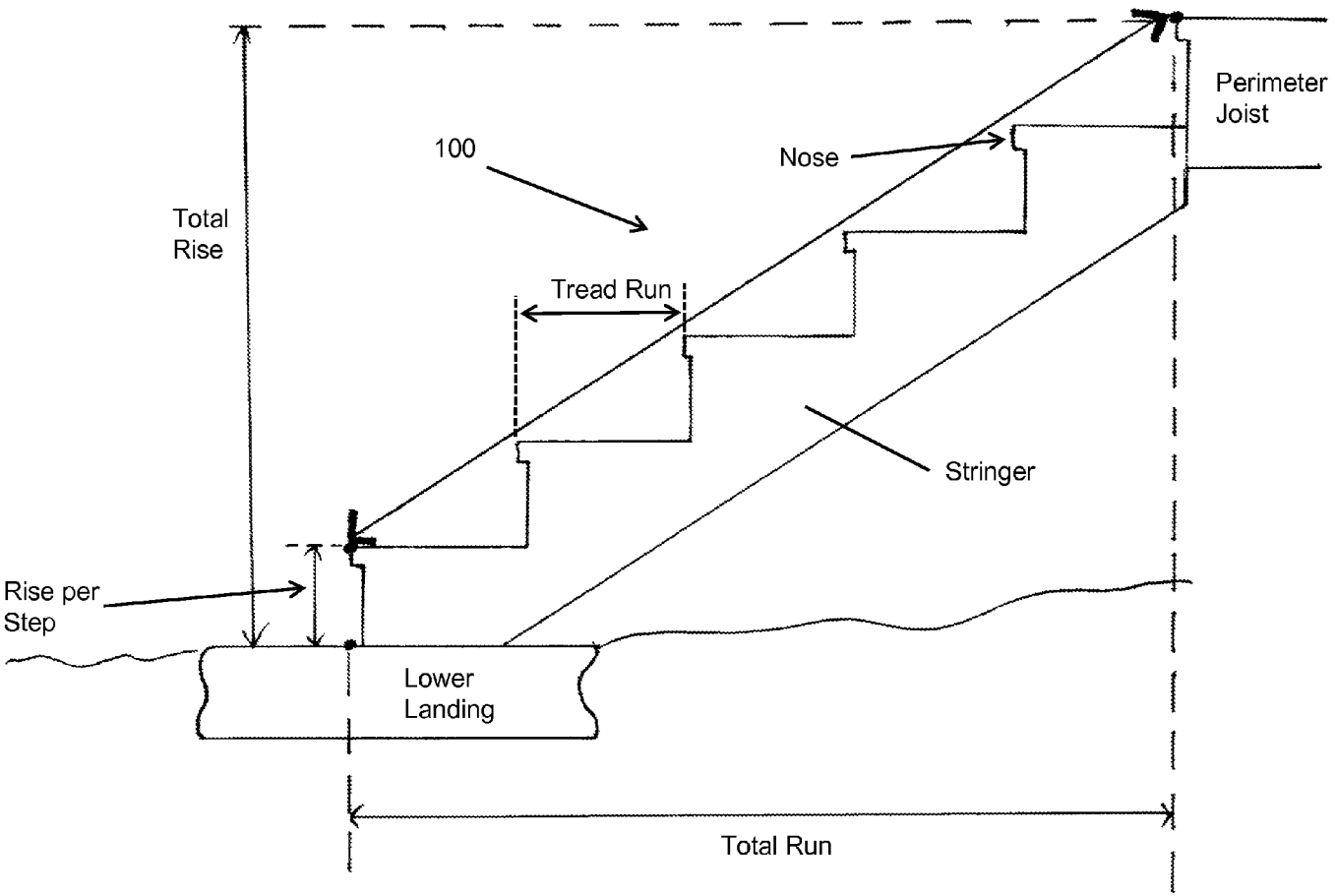
FIG. 1 is a cross-section view of a stair unit in place between a ground landing and a first floor perimeter joist.

Before constructing a stair unit, its geometry must be determined: its total height, the rise and run of each step, the number of steps, and the angle of the stair unit relative to the ground or lower level. FIG. 1 illustrates a cross-section view of a stair unit 100. In a traditional method of determining the primary geometry, based on the total rise of the stairs (taking into account any slope of the ground at the bottom, if outside) as well as the approximate desired rise per step, the number of rises is calculated by dividing the total rise by the desired rise per step (the number of rises will be one more than the number of treads). If the resulting number is not an integer, the remainder can be apportioned equally among all of the steps to increase the rise of each, up to a maximum rise height. Otherwise the builder would have to increase the number of treads.

In one embodiment of the present invention, a table is used as an alternate way to determine this geometry. This alternate way can even be used in conjunction with the traditional method to cross check the calculations for accuracy. First, the builder estimates the landing location. The builder then estimates the total rise. Using this estimated total rise, the table is consulted to determine the appropriate number of rises and rise per tread. TABLE I is an example of such a table, showing the rise per tread from 6 to 8 inches and 2 to 11 for the number of rises.

TABLE I (values are in inches)

| | | #Tread 1 | | | | | | | | |
|---|---|---|---|---|---|---|---|---|---|---|
| Rise | | 2 | 3 | 4 | 5 | 6 | 7 | 8 | 9 | 10 |
| | | #Rises 2 | | | | | | | | |
| per tread | | 3 | 4 | 5 | 6 | 7 | 8 | 9 | 10 | 11 |
| 8 | 16 | 24 | 32 | 40 | 48 | 56 | 64 | 72 | 80 | 88 |
| 7⅞ | 15⅝ | 23⅝ | 31⅛ | 39⅜ | 47⅞ | 55⅛ | 63 | 70⅞ | 78⅝ | 86⅝ |
| 7¾ | 15¼ | 23⅞ | 31 | 38⅝ | 46⅛ | 54⅞ | 62 | 69⅝ | 77⅛ | 85⅞ |
| 7⅝ | 15⅞ | 22⅞ | 30⅛ | 38⅛ | 45⅝ | 53⅜ | 61 | 68⅝ | 76⅞ | 83⅞ |
| 7½ | 15 | 22⅛ | 30 | 37⅛ | 45 | 52⅛ | 60 | 67⅛ | 75 | 82⅛ |
| 7⅜ | 14⅝ | 22⅛ | 29⅛ | 36⅞ | 44⅞ | 51⅝ | 59 | 66⅜ | 73⅝ | 81⅛ |
| 7¼ | 14⅛ | 21⅝ | 29 | 36⅞ | 43⅛ | 50⅝ | 58 | 65⅞ | 72⅛ | 79⅝ |
| 7⅛ | 14⅞ | 21⅜ | 28⅛ | 35⅝ | 42⅝ | 49⅞ | 57 | 64⅛ | 71⅞ | 78⅜ |
| 7 | 14 | 21 | 28 | 35 | 42 | 49 | 56 | 63 | 70 | 77 |
| 6⅞ | 13⅝ | 20⅝ | 27⅛ | 34⅜ | 41⅞ | 48⅛ | 55 | 61⅞ | 68⅝ | 75⅝ |
| 6¾ | 13⅛ | 20⅞ | 27 | 33⅝ | 40⅛ | 47⅞ | 54 | 60⅝ | 67⅛ | 74⅞ |
| 6⅝ | 13⅞ | 19⅞ | 26⅛ | 33⅛ | 39⅝ | 46⅜ | 53 | 59⅝ | 66⅞ | 72⅞ |
| 6½ | 13 | 19⅛ | 26 | 32⅛ | 39 | 45⅛ | 52 | 58⅛ | 65 | 71⅛ |
| 6⅜ | 12⅝ | 19⅛ | 25⅛ | 31⅞ | 38⅞ | 44⅝ | 51 | 57⅜ | 63⅝ | 70⅛ |
| 6¼ | 12⅛ | 18⅝ | 25 | 31⅞ | 37⅛ | 43⅝ | 50 | 56⅞ | 62⅛ | 68⅝ |

TABLE I-continued (values are in inches)

| Rise | | #Tread 1 | | | | | | | | |
|---|---|---|---|---|---|---|---|---|---|---|
| | | 2 | 3 | 4 | 5 | 6 | 7 | 8 | 9 | 10 |
| | | #Rises 2 | | | | | | | | |
| per tread | | 3 | 4 | 5 | 6 | 7 | 8 | 9 | 10 | 11 |
| 6⅛ | 12⅜ | 18⅜ | 24⅛ | 30⅝ | 36⅝ | 42⅞ | 49 | 55⅛ | 61⅜ | 67⅜ |
| 6 | 12 | 18 | 24 | 30 | 36 | 42 | 48 | 54 | 60 | 66 |

The table is based upon a multiplication chart, calculated to eighth-inch increments. Tables I, II, and III can be produced using increments as small as desired, or even using the metric system; ⅛ inch increments were chosen for this example for practicality and efficiency. The builder looks on the inside of the table to find the numbers close to the estimated total rise. Table I illustrates that there may be more than one number inside the table that may work for a given stair unit. That is, there may be more than one combination of number of rises and rise per tread that will achieve a given total rise. The builder chooses the most desirable option, and use the corresponding numbers for number of rises and rise per tread to build the desired stair unit. Generally, it is more desirable to build a stair unit with the fewest stair treads because it costs the least. Other factors that make an option more desirable are the closeness to the target total rise number and the desire for an ergonomic rise per tread. Usually, a rise per tread in the range of around 7 inches to 7½ inches is a desirable range for rise per tread.

If the estimated total rise is not found on the table, a number that is close to it may be chosen. In that case, where it is not possible from the table to build a precise stair unit, it is better to choose a number slightly smaller than it is to choose a number slightly bigger. This is because it is better for the stair unit to be slightly too short than slightly too tall. A slightly shorter stair unit causes the treads slope slightly downward toward the lower surface, which is more ergonomic for the end users. Precision is ideal, but the building codes generally allow for as much as a ¼ inch slope in the total rise for every 12 inches total run, or 1 inch for every 48 inches, which is just under ¼ inch per typical tread. Adjustments may be employed in this system to account for a realistic expectation of a lack of precision, including the use of other tables and calibrations for the tooling.

For an example, if the estimated total rise from the estimated landing was 52 inches, the builder looks for the numbers inside TABLE I that are close to 52 inches, preferably without going over 52 inches. In this case, some choices from Table I are:

- 7-rise stair with a 7½ inch rise per tread (which yields 52½ inches)
- 7-rise stair with a 7⅜ inch rise per tread (which yields 51⅝ inches)
- 8-rise stair with a 6½ inch rise per tread (which yields 52 inches)
- 8-rise stair with a 6⅜ inch rise per tread (which yields 51 inches)

The builder then determines which option among the choices is the most desirable. The builder would most likely choose the second option—a 7 rise stair with a 7⅜ inch rise per tread.

The table also allows cross checking of the accuracy of the measurements for the stair unit. After the number of rises and the rise per tread have been determined from TABLE I, the builder may reference TABLE III (below). Using the previous example, there are 7 rises with a 7⅜ inch rise per tread. The number of treads, in this case 6, is multiplied by the rise per tread, 11-inches, for a product of 66 inches. This is the estimated total run. Using an imaginary vertical line that extends down from the edge of the upper floor or deck surface or perimeter joist, the estimated total run distance, 66 inches, is measured outward in the direction of the estimated landing. This gives the point directly below the point that represents the nosing of the first tread. In TABLE III, the total hypotenuse, 79 7/16 inches, is located. A measuring tape can be pulled from the edge of the upper floor or deck surface to the point that represents the nosing of the first tread, roughly 7⅜ inches above the ground. The end point of the estimated total run, 7⅜ inches above the ground, and the end point of this total hypotenuse, with reasonable tolerance, should be very close to each other. If not, the builder knows he must find the error, and the calculations must be done again, thereby nearly eliminating the very expensive possibility of building or ordering the wrong sized stair unit. Also, the total hypotenuse can be very useful to the builder in determining details about the stair landing, enabling the landing, if necessary, to be constructed before the stair unit. Thus, using the total hypotenuse from the table, the builder can expect a pre-built landing and an accurately built stairway to match. The total hypotenuse can also help in determining the size of the stringer material to be ordered.

Figure 2:
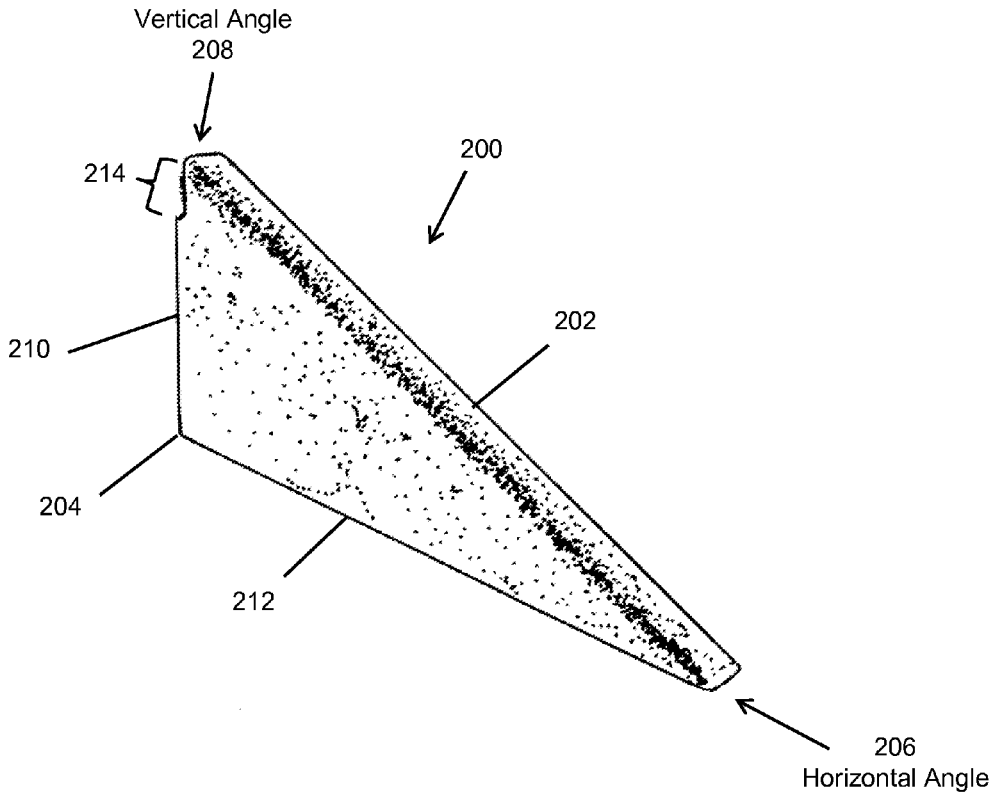
FIG. 2 is a perspective view of a template triangle used to build a stair unit.

Rather than rely on a framing square and on-the-job calculations, a table or calculation method provides geometric values to enable the builder to cut right-angle template triangles to be used during construction of the stair unit. FIG. 2 illustrates such a template triangle 200 cut from a man-made material, although natural wood may be used as well. For a better looking finished stair unit, the template triangles are preferably cut from composite fascia or trim. The table or calculation method may be provided as a spreadsheet for use on a computer, portable computer, or even a smart phone, or may be provided as a hard-copy printout. TABLE II is an example of such a table based on a tread run of 11 inches for rises from 6 to 8 inches and where the desired tread nosing is ¼ inches. These tables or calculation methods could combine Tables I, II, and III. Values would change with changes in the tread run or nosing, and more precise increments could be used.

TABLE II

| Rise | Horizontal Angle | Vertical Angle | Stair building hypotenuse | Manf. hypotenuse |
|---|---|---|---|---|
| 8 | 36.0 | 54.0 | 13 ⅝ | 13 15/16 |
| 7 ⅞ | 35.6 | 54.4 | 13 ½ | 13 13/16 |
| 7 ⅝ | 35.2 | 54.8 | 13 7/16 | 13 ¾ |
| 7 ⅝ | 34.7 | 55.3 | 13 ⅜ | 13 11/16 |

TABLE II-continued

| Rise | Horizontal Angle | Vertical Angle | Stair building hypotenuse | Manf. hypotenuse |
|---|---|---|---|---|
| 7 4/8 | 34.3 | 55.7 | 13 5/16 | 13 5/8 |
| 7 3/8 | 33.8 | 56.2 | 13 1/4 | 13 9/16 |
| 7 2/8 | 33.4 | 56.6 | 13 3/16 | 13 1/2 |
| 7 1/8 | 32.9 | 57.1 | 13 1/8 | 13 3/8 |
| 7 | 32.5 | 57.5 | 13 1/16 | 13 5/16 |
| 6 7/8 | 32.0 | 58.0 | 13 | 13 1/4 |
| 6 6/8 | 31.5 | 58.5 | 12 7/8 | 13 3/16 |
| 6 5/8 | 31.1 | 58.9 | 12 13/16 | 13 1/8 |
| 6 4/8 | 30.6 | 59.4 | 12 3/4 | 13 1/16 |
| 6 3/8 | 30.1 | 59.9 | 12 11/16 | 13 |
| 6 2/8 | 29.6 | 60.4 | 12 5/8 | 12 15/16 |
| 6 1/8 | 29.1 | 60.9 | 12 9/16 | 12 7/8 |
| 6 | 28.6 | 61.4 | 12 1/2 | 12 13/16 |

(values are in inches or degrees)

The right triangle's hypotenuse 202 and angles 206, 208 are calculated based on the right angle 204, rise, run and tread nosing or overhang as follows:

The Horizontal Angle 206 in degrees is:

90-Vertical Angle [Equation #1]

The Vertical Angle 208 in degrees is:

arctan(run/rise) [Equation #2]

The Stair building hypotenuse 202 of the right triangle is:

the square root of the sum of run squared and the rise squared [Equation #3]

The Manufacturing hypotenuse of the right triangle is:

[1/sin(vertical angle)]*(run)(where the vertical angle is in radians) [Equation #4]

As an example, if the rise 210 is 7⅜ inches and the run 212 is 11 inches, the hypotenuse 202 of each right triangle, when first cut, will be 13 9/16 inches and the angles 204, 206, 208 will be 90, 33.8 and 56.2 degrees, respectively. After the notch for the tread nosing is cut, the template triangle will have the angles as listed above, a proper rise of 7⅜ inches and a hypotenuse of 13¼. These are the angles and dimensions necessary to build the stair unit.

If a hard-copy printout is provided, a different table may be printed for different runs, including one based on a typical run of 11 inches. If a builder uses a different run, he will consult another provided table corresponding to that run.

Figure 9:
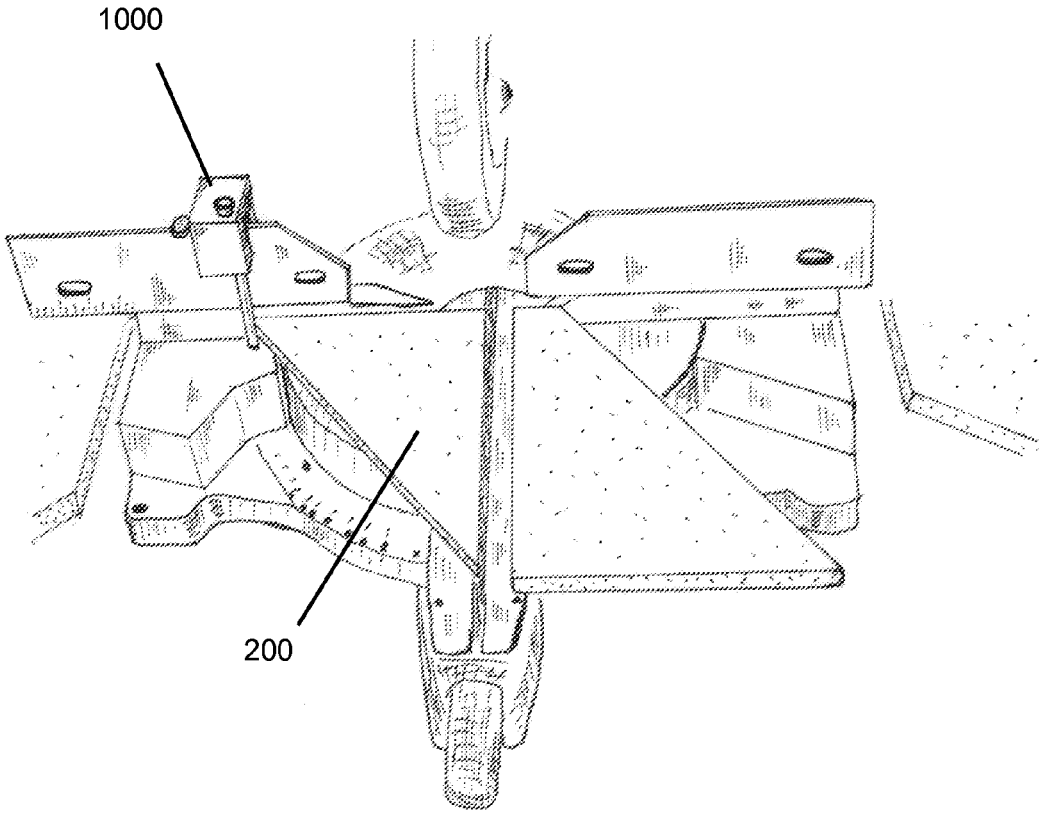
FIG. 9 illustrates the use of a fence stop used to cut the template triangles of FIG. 2 from parallelograms.

Using the angles and hypotenuse from the table, as many sets of triangles 200 as are needed (two template triangles for each tread) are cut, such as with a sliding compound miter saw, a radial-arm saw or the like and preferably using a specially designed saw fence stop as illustrated in FIG. 9.

Figure 10A:
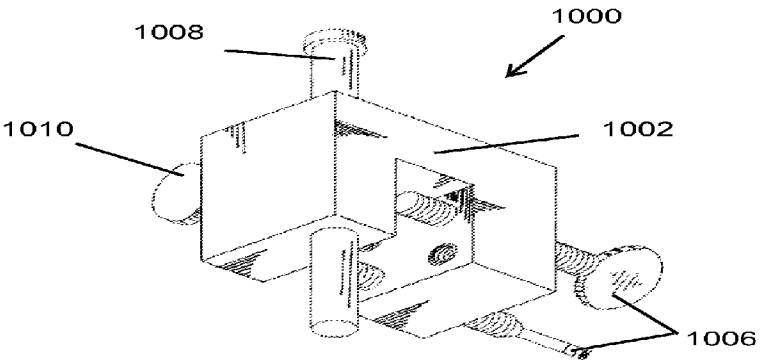
FIGS. 10A and 10B are perspective views of the fence stop shown in FIG. 9.
Figure 10B:
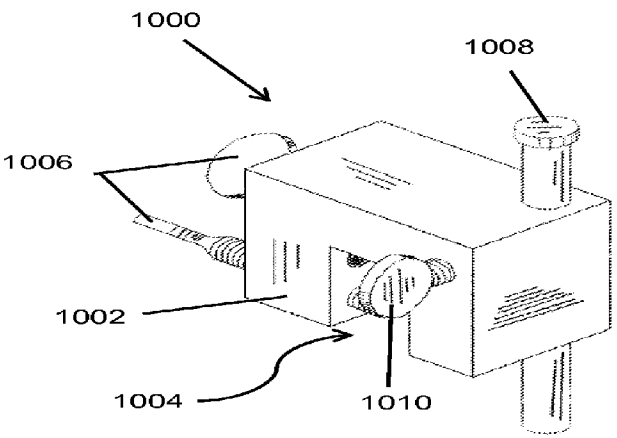

FIGS. 10A and 10B are perspective views of the fence stop 1000. The fence stop 1000 includes a U-shaped base 1002 having a channel 1004 dimensioned to fit over the top of a saw fence, as illustrated in FIG. 9, and allowing the fence stop 1000 to slide along the fence. One or more thumb screws 1006 lock the fence stop 1000 on the fence once it has been slid to the desired position. The fence stop 1000 also includes a rod 1008 that is slidable through a vertical hole formed through one side of the base. Another thumb screw 1010 may be used to lock the rod 1008 in a desired position, including in a fully lowered position or a fully raised, out of the way position. When the rod 1008 is in the lowered position, the rod 1008 will be at a predetermined distance from the fence.

Preferably, the fence has markings indicating the distance from the saw blade to a point of contact of the rod 1008 with the angled point of the board being cut, as described below ("tangential point of contact"). For convenience, the numbers on the markings may be offset by the distance between the tangential point of contact of the rod 1008 and one edge of the base 1002, enabling the fence stop 1000 to be slid along the fence so that the edge of the base 1002 is aligned with the fence mark that indicates the desired rise of the step (because of the offset, the actual distance from the saw blade to the mark may be different than the number on the mark, but the marks only indicate the distance from the tangential point of contact of the rod to the saw blade).

Figure 11A:
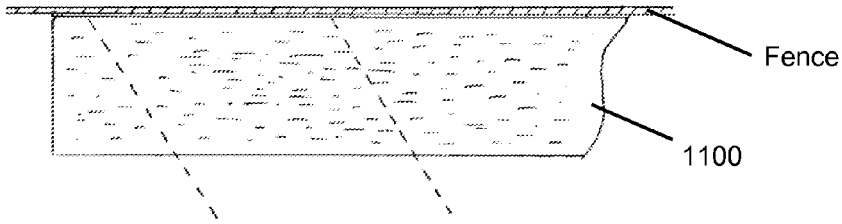
FIGS. 11A, 11B and 11C illustrate a process of cutting the template triangles of FIG. 2 from stock material.
Figure 11B:
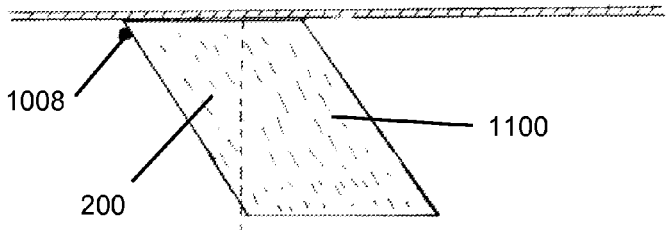
Figure 11C:
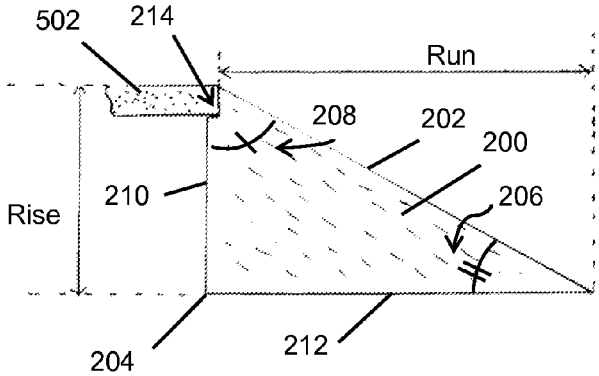

FIGS. 11A, 11B and 11C illustrate a board placed against the fence and being cut into a parallelogram 1100 (FIG. 11A), a triangle 200 being cut from the parallelogram 1100 using the fence stop (only the rod 1008 is shown in FIG. 11B), and a side view of the template triangle 200 after the notch 214 has been cut, showing the front end of a tread plank positioned in the notch 214 (FIG. 11C).

When cutting template triangles from parallelograms, the cutting angle of the saw is set to the horizontal angle and one side of a board is cut (the horizontal angle is used even though the angle actually being cut is the vertical angle as the zero degree angle marked on a typical saw is 90 degrees). For efficiency, a similar cut may be made at a distance from the first cut equal to a little more than stair-building hypotenuse, thereby forming a parallelogram. The saw blade is then readjusted to a 90-degree position and the parallelogram is placed on the saw with the first cut edge (the edge that will become the rise of the first template triangle) resting against the fence. After the fence stop 1000 is locked at the proper distance from the saw blade and the rod 1008 lowered and locked, the parallelogram is slid along the fence until one point of the parallelogram is stopped by the rod 1008. Because the lowered rod 1008 is a predetermined distance from the fence, a small portion of the point of the triangle will be positioned between the rod 1008 and the fence, again as illustrated in FIG. 9, thereby providing a proper offset for the nose notch to be cut. Two cuts are made which results in two appropriately sized right triangles from each parallelogram.

To accommodate the overhang or nosing of each tread, an appropriately dimensioned notch 214 is cut in what will become the top edge of each template triangle 200. A router with a stop set to the thickness of the tread material works well, but other methods may also be used. The notch 214 preferably has a rounded interior corner with a radius to match any rounded edge of the tread material. Before notching the triangle, the triangles are slightly bigger than the stair unit requires due to the offset provided by the distance of the tangential point of the rod 1008 from the fence. After the notch is cut, the template triangle is complete and the resulting shape has the correct dimensions that will facilitate the building of the stair unit.

To convert the slightly larger, pre-notched "manufacturing" triangle into an appropriately sized "stair-building" triangle, the method described above relies on the tangential point of contact. The tangential point of contact is the point where the rod touches the material being cut. The rod 1008 and the saw fence together receive the acute angle of the parallelogram-shaped material 1100 as illustrated in FIG. 11B. The fence stop is designed and calibrated so that the tangential point of contact is, within a reasonable tolerance, the top point 208 of the notched stair-building triangle: the distance from the tangential point of contact to the saw blade is the desired rise dimension and the distance from the tangential point of contact to the saw fence is the desired nosing offset dimension.

For example, if the desired nosing offset is ¼ inch, the saw stop is designed so that the tangential point of contact is ¼ inch from the saw fence. To achieve that dimension, the rod

1008 will have a diameter of ⅜ inch, and be located 0.163 inch from the saw fence. Furthermore, the saw stop is slid and locked at a position where the distance between the tangential point of contact and the saw blade is the desired rise dimension. These values provide a satisfactory offset for a ¼ inch nosing offset (the depth of the notch 214) on a stair having a rise of 7 inches and a run of 11 inches. After the notch 214 for the nosing is cut in the template triangle 200, the new top point of the template triangle 200 will be a distance equal to the rise from what will be the horizontal edge (run) 212 of the template triangle.

Figure 3:
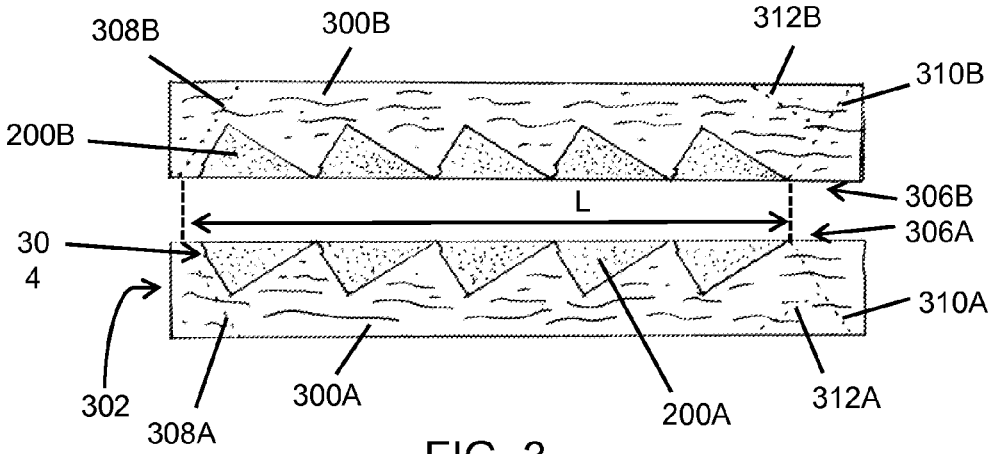
FIG. 3 illustrates two stringers with template triangles of FIG. 2 secured to their sides.

FIG. 3 is a top view of a pair of stringers 300A, 300B (referred to generally as 300) with five triangles 200 attached to the inside of each stringer 300. The length L of each stringer may be calculated by measuring the total length of all of the hypotenuses of the attached template triangles and then adding about 6 inches. A printed table of triangle hypotenuse increments may be provided for convenience. TABLE III is an example of such a table for a stair unit with up to 7 steps and a rise between 6 to 8 inches, again using a run of 11 inches and an overhang of ¼ inch.

TABLE III (values are in inches)

| | | # of treads | | | | | |
|---|---|---|---|---|---|---|---|
| | Stair building | 2 | 3 | 4 | 5 | 6 | 7 |
| | | # rises | | | | | |
| Rise | hypotenuse | 3 | 4 | 5 | 6 | 7 | 8 |
| 8 | 13 10/16 | 27 3/16 | 40 13/16 | 54 6/16 | 68 | 81 10/16 | 95 3/16 |
| 7⅞ | 13 8/16 | 27 1/16 | 40 9/16 | 54 2/16 | 67 10/16 | 81 3/16 | 94 11/16 |
| 7¾ | 13 7/16 | 26 15/16 | 40 6/16 | 53 13/16 | 67 4/16 | 80 12/16 | 94 3/16 |
| 7⅝ | 13 6/16 | 26 12/16 | 40 2/16 | 53 9/16 | 66 15/16 | 80 5/16 | 93 11/16 |
| 7½ | 13 3/16 | 26 10/16 | 39 15/16 | 53 4/16 | 66 9/16 | 79 14/16 | 93 3/16 |
| 7⅜ | 13 4/16 | 26 8/16 | 39 12/16 | 53 | 66 3/16 | 79 7/16 | 92 11/16 |
| 7¼ | 13 3/16 | 26 6/16 | 39 8/16 | 52 11/16 | 65 14/16 | 79 1/16 | 92 4/16 |
| 7⅛ | 13 2/16 | 26 3/16 | 39 5/16 | 52 7/16 | 65 8/16 | 78 10/16 | 91 12/16 |
| 7 | 13 1/16 | 26 1/16 | 39 2/16 | 52 2/16 | 65 3/16 | 78 4/16 | 91 4/16 |
| 6⅞ | 13 | 25 15/16 | 38 15/16 | 51 14/16 | 64 14/16 | 77 13/16 | 90 13/16 |
| 6¾ | 12 14/16 | 25 13/16 | 38 11/16 | 51 10/16 | 64 8/16 | 77 7/16 | 90 5/16 |
| 6⅝ | 12 13/16 | 25 11/16 | 38 8/16 | 51 6/16 | 64 3/16 | 77 1/16 | 89 14/16 |
| 6½ | 12 12/16 | 25 9/16 | 38 5/16 | 51 2/16 | 63 14/16 | 76 11/16 | 89 7/16 |
| 6⅜ | 12 11/16 | 25 7/16 | 38 2/16 | 50 14/16 | 63 9/16 | 76 5/16 | 89 |
| 6¼ | 12 10/16 | 25 5/16 | 37 15/16 | 50 10/16 | 63 4/16 | 75 15/16 | 88 9/16 |
| 6⅛ | 12 9/16 | 25 3/16 | 37 12/16 | 50 6/16 | 62 15/16 | 75 9/16 | 88 2/16 |
| 6 | 12 8/16 | 25 1/16 | 37 9/16 | 50 2/16 | 62 10/16 | 75 3/16 | 87 11/16 |

Although the distance from the fence to the tangential point of contact in the above example was determined for a tread having a rise of 7 inches and a run of 11 inches, the value is also adequate for treads having other rises and runs in the commonly used range. This is because the differences in distances between the rod and saw fence described in the above example and those calculated for other rises and runs are so small as to be well within the tolerances of the ability to set the angle of the saw and the distance of the fence stop 1000 from the saw blade. Consequently, unless the rise and run vary greatly from the 7 and 11 inches of the foregoing example, it may not be necessary to provide a different fence stop.

Using a round rod 1008 in the fence stop 1000 also provides a more secure stop for the angled end of the parallelogram than would be provided with a stop having a flat edge perpendicular to the fence.

If the total rise of the stairs is known ahead of time, the template triangles 200 may be cut off-site. However, the exact rise may not be known ahead of time. Nonetheless, the template triangles 200 may be cut just as easily on-site with the appropriate saw and the saw fence stop.

If the template triangles 200 will be a permanent part of the stairs, they may be cut from fascia or trim, including man-made material, that matches or complements the tread material. If the template triangles 200 are only to be used temporarily to assist in the geometry and construction of the stairs, they may be cut from an inexpensive material such as OSB or plywood.

The value in each cell beginning with the third column of a row is the total length of the stringer (as measured from the top of the top edge to the bottom of the top edge) and is equal to the hypotenuse (second column) times the number of treads (first row). This equation may be used to extend the table to cover more than 7 steps as well as to cover rises outside of the range in TABLE III. For convenience, the information contained in TABLES I, II and III may be combined into a single table.

Using appropriately-sized lumber, such as 2×10 or larger dimensional lumber, measuring from what will become the top 302 of each stringer 300, a mark can be made first at location 304 where the builder decides the very top of the stringer will be and then every hypotenuse length along the stringer from that point towards what will become the bottom 306. For convenience in this description, the values in a row of TABLE III will be used. Thus, for a stair with 6 treads, each having a 7⅜ inch rise, marks would be made at 0, 13 4/16, 26½, 39¾, . . . , 79 7/16 inches. For consistency and accuracy, it is preferable that the set of two stringers 300A, 300B be laid next to each other and marked at the same time.

After the template triangles 200 have been cut and the stringers 300 marked, the template triangles 200 are attached to what will become the inside surface of the stringers 300 with their hypotenuses even with what will become the top edge of the stringers. The top point of each template triangle 200 should be aligned with each hypotenuse mark on the stringer. Depending on the set of template triangles, there may be very small gaps between the template triangles 200. If the template triangles 200 will be a permanent part of the stairs, they may be secured to the stringers 300 with screws or other permanent fastener. If the template triangles are only to be used temporarily to assist in the construction of the stairs, they may be secured to the stringers 300 with easy to remove fasteners, such as brad nails.

Figure 4:
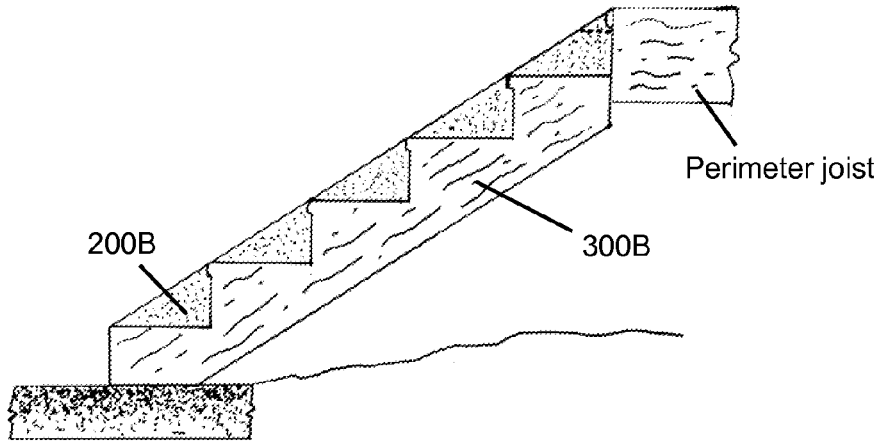
FIG. 4 is a side view of a stringer of FIG. 3, with appropriate end cuts, in place as part of a stair unit.

Still referring to FIG. 3, after the template triangles 200 have been secured, the ends of the stringers 300 may be cut to length at the appropriate angles using the template triangles as a guide. At the top 302 of each stringer 300A, 300B, the builder cuts one line 308A, 308B parallel to the rise edge of the top template triangles 200A, 200B so that the stringers 300 can be attached to the perimeter joist leaving some of the stringer exposed to account for different attachment methods. At the bottom 306A, 306B of each stringer 300A, 300B, the builder cuts the stringers 300A, 300B perpendicular 310A, 310B to the bottom edge of the bottom template triangles. The bottom of each stringer 300A, 300B is then cut parallel 312A, 312B to the bottom edge of the template triangles at a distance equal to the rise of the template triangles. As a result, when the stringers 300 are secured to the perimeter joists, their bottom edges are flat against the landing surface and the front of the top edges are vertical as illustrated in FIG. 4.

Figure 5:
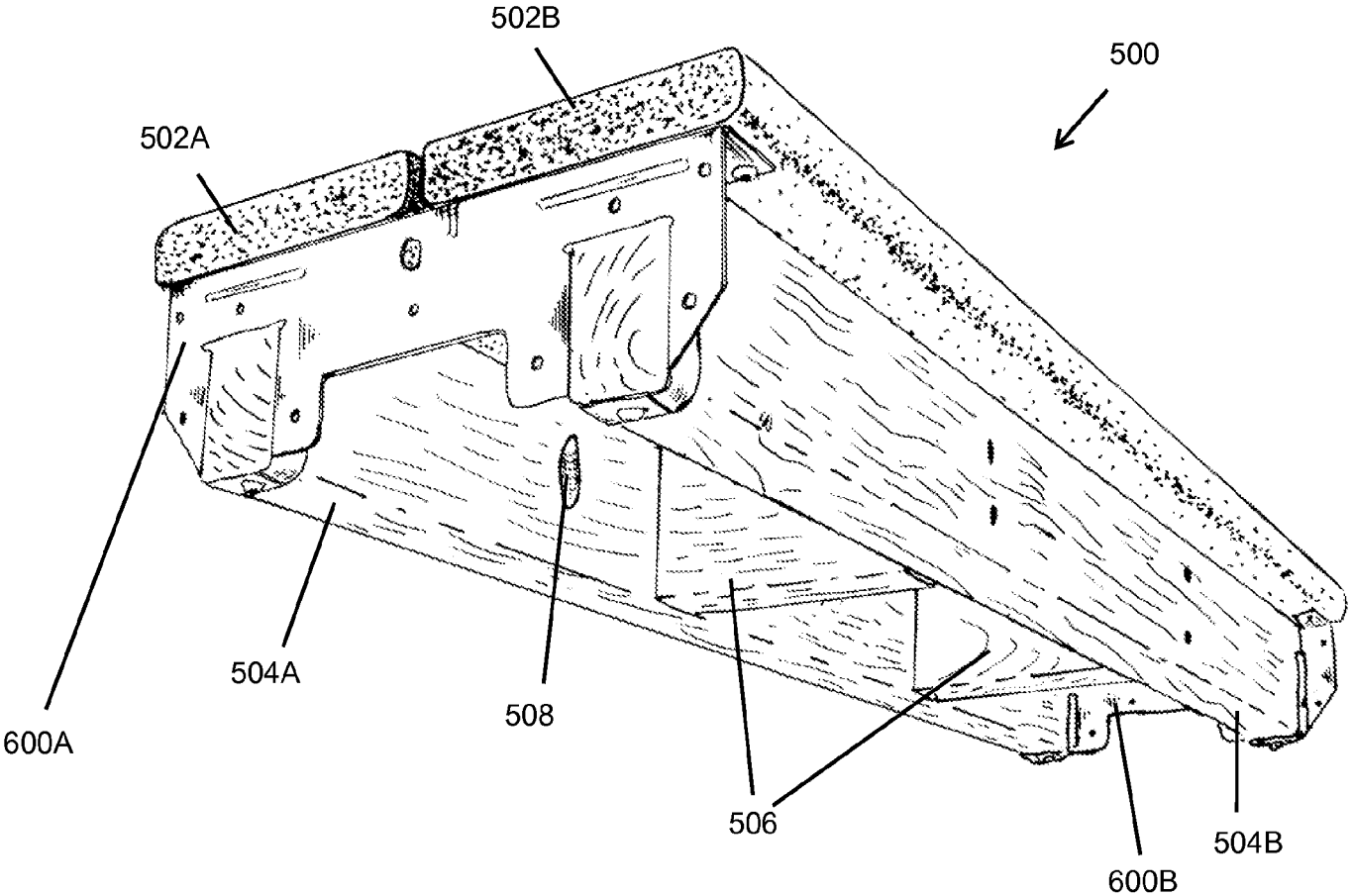
FIG. 5 is a perspective view of the underside of a tread module that may be used to build a stair unit.

Each tread may be constructed as an independent module and may be as wide as desired up the to the strength limits of the tread frame. FIG. 5 is a perspective view of the underside of a tread module 500. A typical tread will be two planks wide, with the planks generally being approximately 5½ inches wide each, and this configuration is used as an example in this description. However, the tread may be wider, such as four planks wide, for different stair designs or to accommodate a walker. Each tread module 500 includes two end brackets 600A, 600*b* (referred to generally as 600), two tread planks 502A, 502B (referred to generally as 502), two joists 504A, 504B (referred to generally as 504) and blocking 506 between the joists 504 (one or more blocks). If the tread is to be more than two planks wide, additional two-plank modules 500 may be used. Alternatively, a bracket formed to hold more than two joists and more than two tread planks may be used, or an elongated version of the bracket can be formed, using just two joists and longer blocking between the joists.

Figure 6:
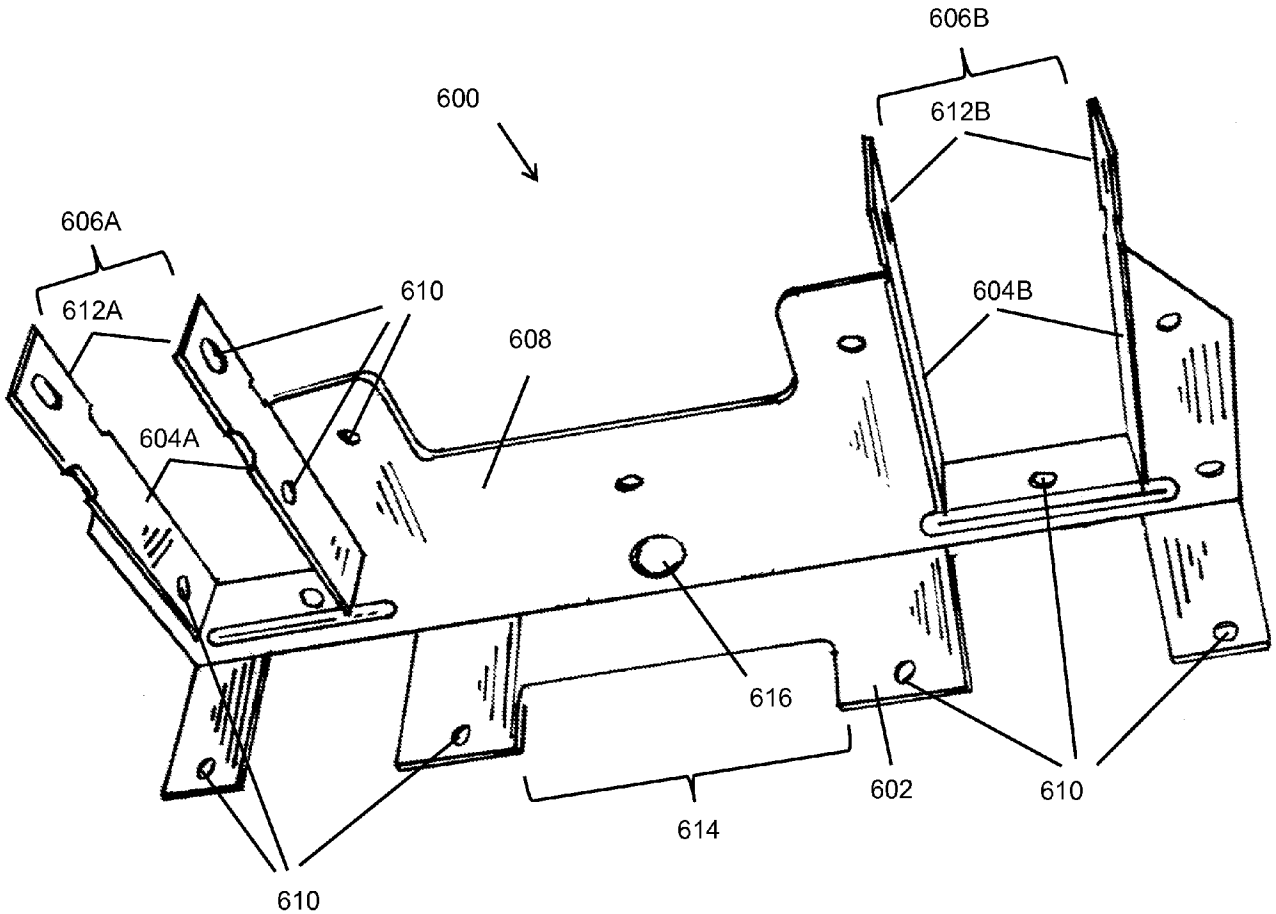
FIG. 6 illustrates a bracket that may be used to build a stair unit.

Referring to FIG. 6, each bracket 600 includes a horizontal flat strip 602, preferably approximately one half inch less in length that the combined width of two tread planks. The flat strips 602 of the two brackets 600A, 600B are placed across the bottoms of the upside-down tread planks 502A, 502B at their ends. Two sets of flanges 604A, 604B, rising vertically from the flat strip 602, form openings 606A, 606B (referred to generally as 606) for the two joists 504A, 504B. The two sets of flanges 604A, 604B are spaced apart so that each of the two joists 504A, 504B will preferably support each of the two tread planks 502A, 502B approximately 1¼ inches from each outside edge of the tread module 500. Wood blocking 506 is placed between the two joists 504A, 504B to create a "mini floor system" as each module 500 is installed on the stair unit 100. Each bracket 600 also includes an additional vertical flange 608 which is orthogonal to both the flat strip 602 and the first set of vertical flanges 604A, 604B. The second vertical flange is used to secure the tread module 500 to the insides of the stringers 300. For convenience, holes (some of which are indicated by reference number 610 in FIG. 6) may be pre-drilled in the brackets 600 at appropriate locations for screws to pass through when a bracket 600 is secured to the tread planks 502, joists 504 and stringers 300.

The two joists 504 are cut to span the distance between stringers 300 and will typically be 2×4 or 2×6 lumber, depending on the span. The joists 504A, 504B are placed into the openings 606A, 606B in each of the two brackets 600A, 600B and the brackets 600 secured to the tread planks 502, such as with screws. Tabs 612A, 612B (referred to generally as 612) on the first set of flanges 604A, 604B are bent downward 90 degrees across the exposed edge of each joist 504A, 504B, holding each joist 504 firmly against its respective tread plank 502. This allows for the variation for the thickness in the lumber, because the width of a 2×4 can vary from 3⅜ inches to 3⅝ inches, and while maintaining a tight, bounce-free fit. Fasteners through the brackets 600, including fasteners through the tabs 612, secure the joist 504 within the bracket 600. Preferably, the tread planks 502 and joists 504 are also secured directly to each other. For example, screws may be used through the tops of the tread planks 502 into the joists 504 or through pocket holes (one of which is shown in the FIG. as 508) in the joists 504 into the bottoms of the tread planks 502 for a hidden fastener look.

The unbent tabs 612 of the first set of flanges 604 may be dimensioned for a single size joist, such as a 2×4, a 2×6 or a 2×8. Preferably, however, the tabs 612 may be sufficiently long for two different size joists, such as a 2×4 or a 2×6, to fit into the openings 606 in the brackets 600. Brackets with longer tabs may also be fabricated for a broader range of joist dimensions, such as to accommodate joists of 2×4, 6, 8 and 10 inches, for greater strength or longer spans. It would be unnecessary, therefore, to fabricate and stock different brackets for different size joists.

Although the brackets 600 and tread modules 500 have been described in the context of two joists 504 and two tread planks 502, the invention is not limited to that configuration. For example, brackets may be fabricated with openings for a single joist or for more than two joists to be used with steps of varying depths, that is varying runs measured from the front of the tread to the back. Thus, if the stairs are to be deep enough to accommodate a walker, either two tread modules may be used side-by-side for each step or a bracket with openings for more joists may be used with multiple planks. Alternatively, an elongated version of the bracket can be formed for use with two joists (and blocking between the joists).

After the joists 504 have been inserted into the bracket openings 606, bridging blocks 506 are cut to span the distance between joists 504 and secured to the joists 504, creating the "mini floor system" or "mini deck." The joists 504 provide support for each tread plank 502 along their full length between adjacent stringers 300 and the bridging 506 provides additional cross support.

Tread module 500 components may be cut and even assembled off-site. If the dimensions and geometry of the stringers 300 are known in advance, they too may be cut off-site. The components (manageable in sizes and weights) may then be transported to the construction site at the appropriate time and the stairs assembled. Alternatively, because the exact dimensions and geometry of the stairs may not be known ahead of time, any of the components (tread modules and stringers) may be cut and assembled at the construction site.

Figure 15A:
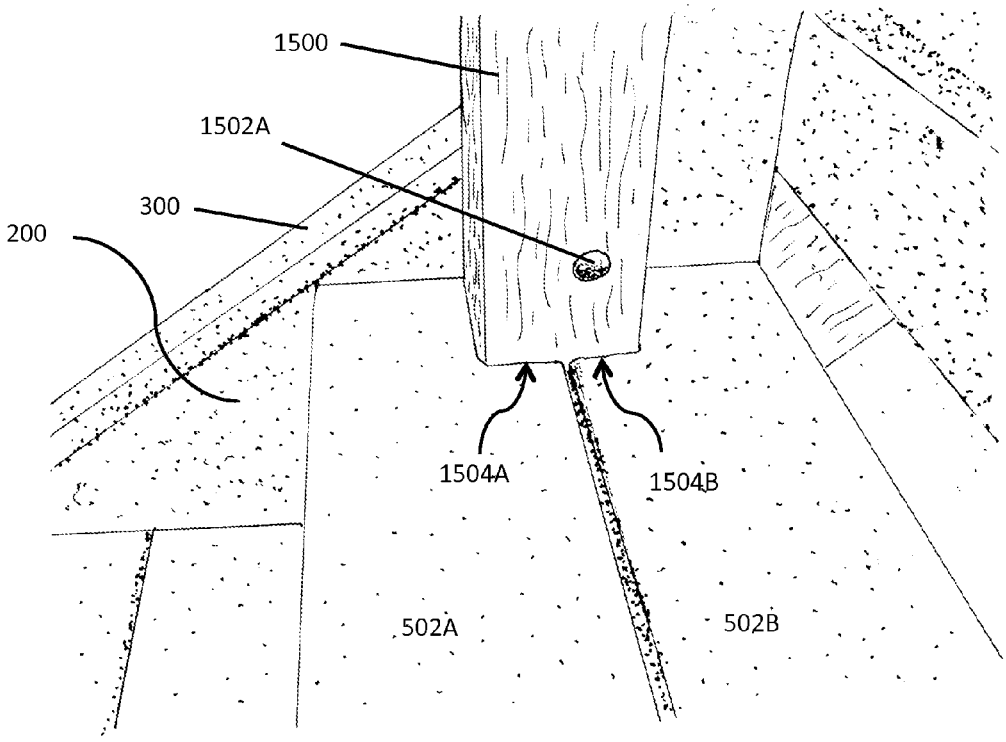
FIG. 15A illustrates a view of the top of a tread module with a handrail post.
Figure 15B:
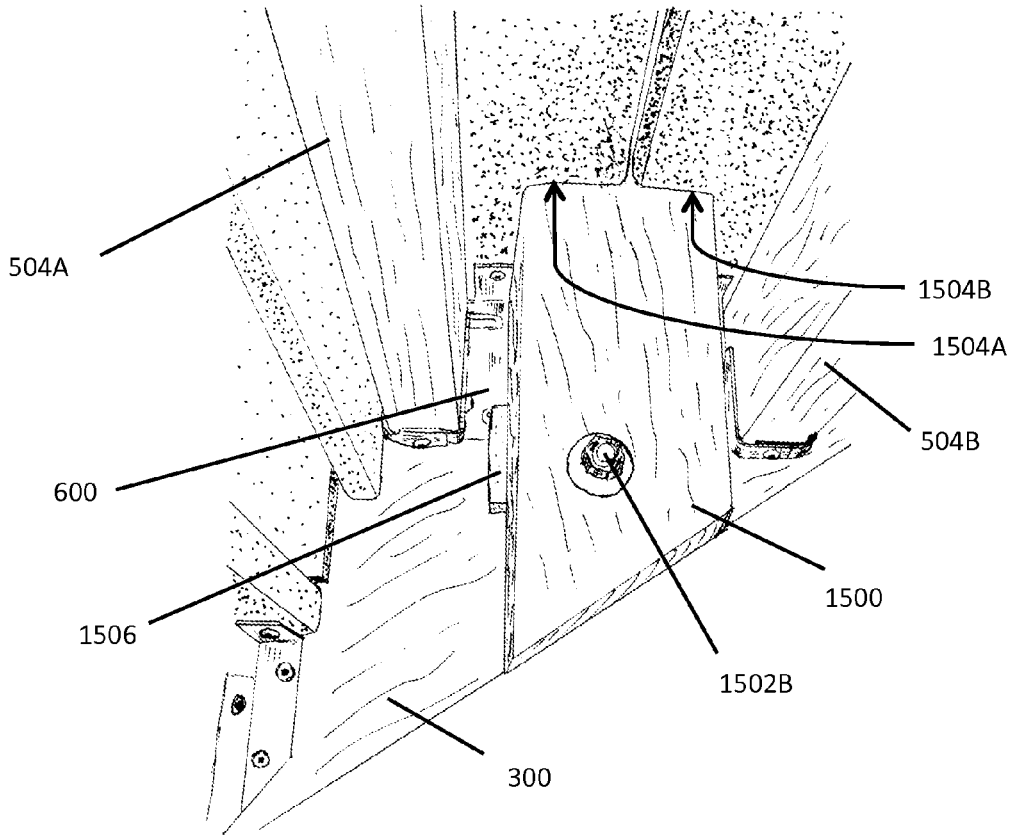
FIG. 15B illustrates a view of the underside of a tread module with a handrail post.

Referring again to FIG. 6, the flat strip 602 of the bracket 600 may include a cutout or notch 614 sized to receive a handrail post 1500 that can be secured to the inside of the stringer 300 with a first bolt 1502A through the stringer 300 and triangle template 200 above the tread planks 502A, 502B (FIG. 15A) and a second bolt 1502B through the stringer 300 (FIG. 15B) below the tread planks 502A, 502B. The post 1500 extends vertically through facing cutouts 1504A, 1504B in the tread planks 502A, 502B, as illustrated in FIGS. 15A, 15B. A spacer 1506 having the same thickness as the template triangle 200 between the bracket 600 and the post 1500 maintains the post 1500 at the same distance from the stringer 300 below the tread planks 502 as the template triangle 200 does above the tread planks 502. Alternatively, the handrail post 1500 may be secured to the outside of the stringer 300 with two bolts, including a bolt through a hole 616 formed through the second vertical flange 608 of the bracket 600.

Figure 7A:
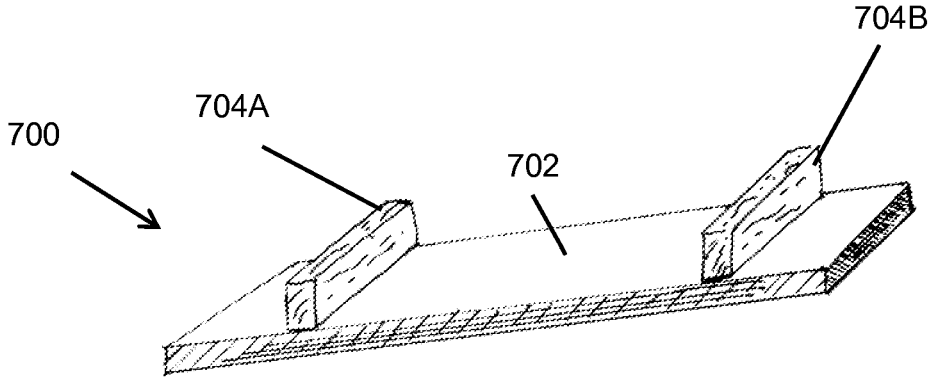
FIGS. 7A, 7B and 7C illustrate a jig that may be used to assemble the tread module of FIG. 5.
Figure 7B:
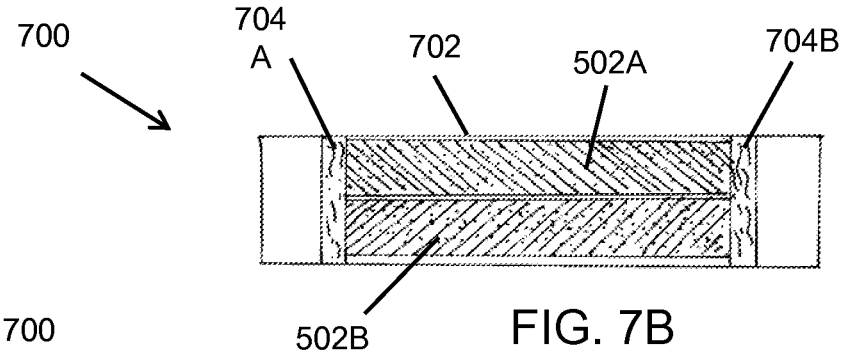
Figure 7C:
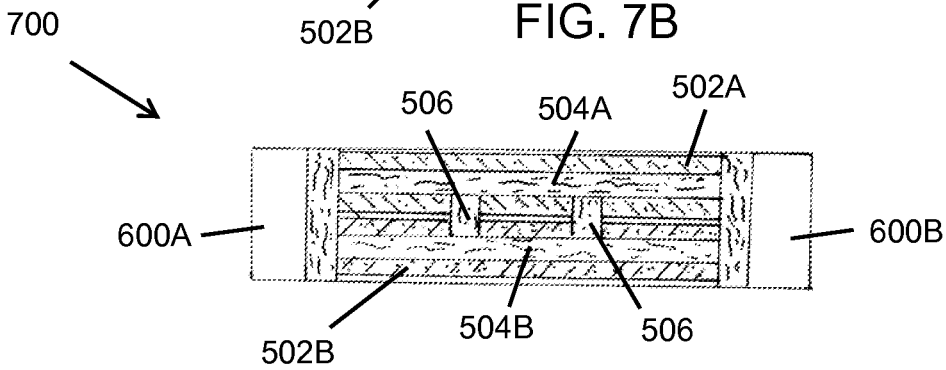

Several methods may be used to secure the tread modules 500 or tread module components to the stringers 300 to complete a stair unit 100, some of which use gravity and all of which use the template triangles 200 together to correctly index the tread module 500 to both the horizontal and vertical angles at the correct place, with a tight fit. Three of those methods will be described. For small stairs, a builder may construct the entire tread module 500 in a jig. FIGS. 7A, 7B and 7C illustrate one such jig 700. The jig 700 may include a board 702, at least as wide and long as the treads, with two blocks 704A, 704B secured to the board 702 spaced apart a distance equal to the tread length. Two tread planks 502 are placed side-by-side and upside-down on the board 702 in the jig 700 (FIG. 7B), spaced a small distance apart to permit water to drain from the finished and installed stair unit (it will be appreciated that the jig may be wider if more than two treads will be used for the tread module). Brackets 600 are placed across the tread planks 502 at each end, and a tread frame constructed on the jig 700 in the brackets 600 (FIG. 7C). The tread frame may optionally include pocket holes, which enable the builder to secure the tread planks 502 so that the fasteners are invisible from the top. All parts, the brackets 600, tread planks 502, and tread frame (the joists 504 and blocking 506), are securely fastened together, completing the tread module 500.

To assemble the stair unit 100, the two stringers 300 with attached template triangles 200 are placed parallel and upside-down on the ground (or flat work surface), the same distance apart as the tread length. The top edge of each stringer 300 is laid on the ground or work surface and with the opposing template triangles 200 facing each other. In this configuration, the stringers 300 act as a jig or template that can receive upside-down tread modules 500 such that gravity and the template triangles 200 correctly index the tread modules 500 to the stringers 300. After the tread modules 500 have been secured between the stringers 300, the entire stair unit 100 is lifted into place and secured to the perimeter joist.

A second method for assembling a stair unit 100 is preferred for small or medium sized stair units and may take place near the deck. A builder may assemble the tread modules 500 in place between the stringers 300 on the ground, again using gravity and the template triangles to correctly index the tread planks 502, the brackets 600 and the tread frame 504, 506. After the tread modules 500 have been secured between the stringers 300, the entire stair unit 100 is lifted into place and secured to the perimeter joist. This second method does not require the jig 700.

Figure 12:
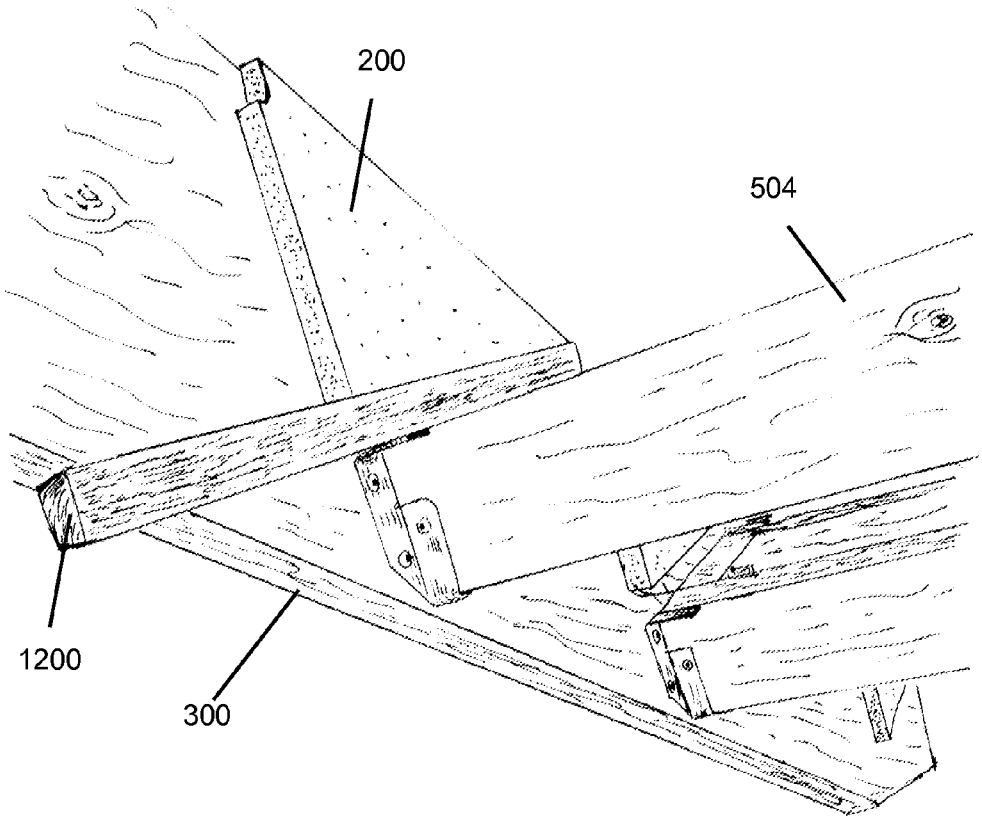
FIG. 12 illustrates a spacer used in one method of assembling the stair unit where the tread frame is applied before the tread material.

A third method for constructing a stair unit 100 is preferred for larger stair units. A stair unit is considered large if the first and second methods would produce a completed (or nearly completed) stair unit that is too heavy to be lifted and secured to the deck without mechanical help. The third method is similar to the second method, because components are assembled and secured inside the upside-down stringers on a flat surface, using the stringers with attached template triangles as a jig or template. In this third method a builder secures the tread frame assemblies, comprised of the tread frame 504, 506 and two brackets 600A, 600B, between the stringers 300, postponing installing the tread planks 502 until the stringers 300, with the tread frame assemblies 504, 506, 600A, 600B, have been raised and secured to the perimeter joists. The builder uses a small movable spacer on each stringer 300, placed on the template triangle's 200 horizontal surface, to substitute for the tread planks 502, so that the tread frame assembly 504, 506, 600A, 600B is correctly indexed to the stair stringers 300 (see FIG. 12). The spacers used to substitute for the tread planks 502 are preferably slightly thicker than the tread planks 502, making it easier to slide the tread planks 502 into place. The spacers are also preferably several inches longer than the tread run so the builder can easily hold and remove them after completing a tread frame assembly 504, 506, 600A, 600B and move them to build and secure another tread frame assembly. In addition to assembling tread frame assemblies 504, 506, 600A, 600B between the stringers 300, tread frame assemblies can be also be pre-assembled offsite and later secured to the stringers. After the tread frame assemblies are secured to the stringers 300, the unit is positioned and secured to the perimeter joist. The builder slides the tread planks 502 between the attached tread frames 504, 506 and template triangles 200 from the back of the tread frame assembly 504, 506, 600A, 600B and secures the tread planks 502 to the tread frame assemblies 504, 506, 600A, 600B.

Figure 8A:
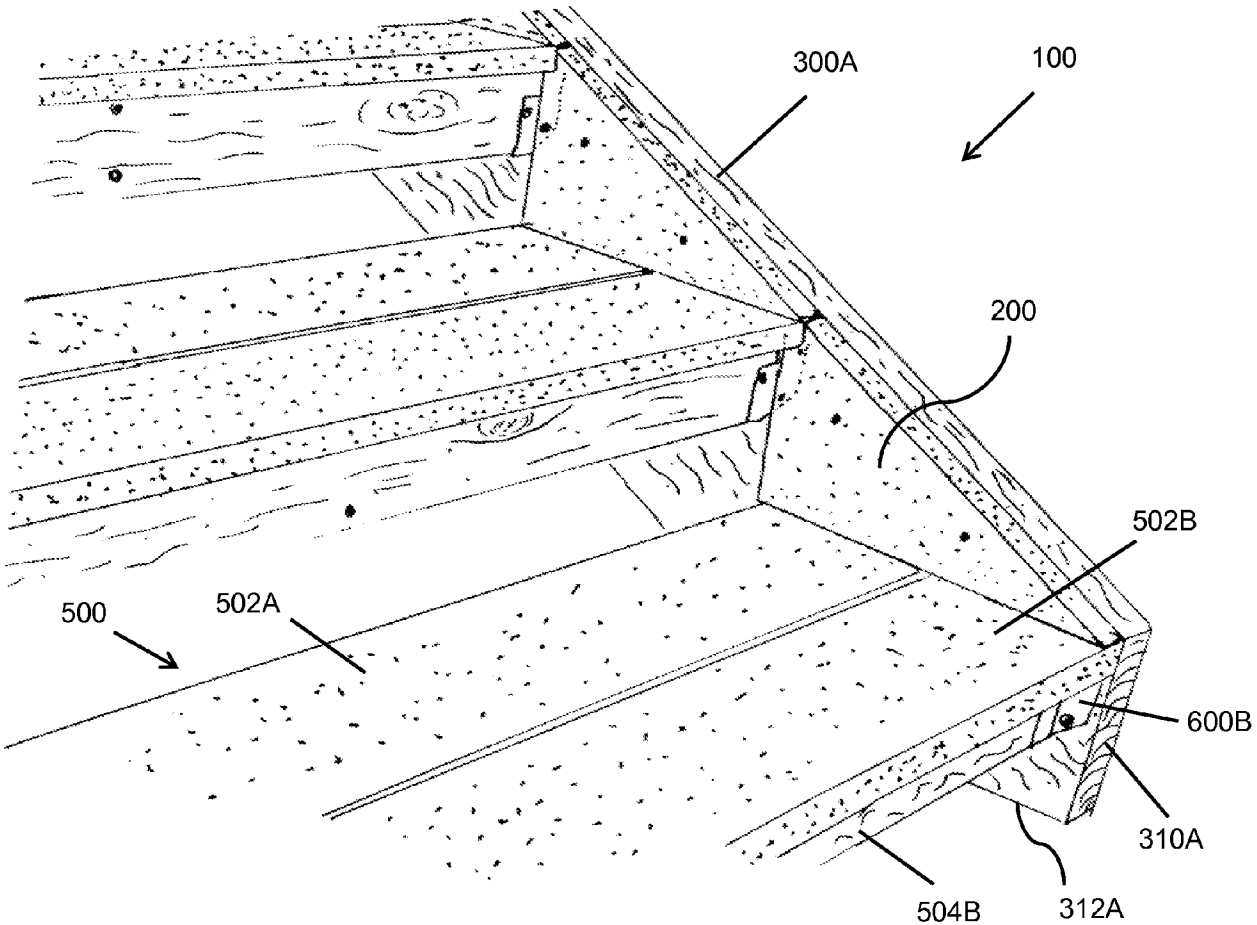
FIG. 8A illustrates a portion of an assembled stair unit, before finish trim.
Figure 8B:
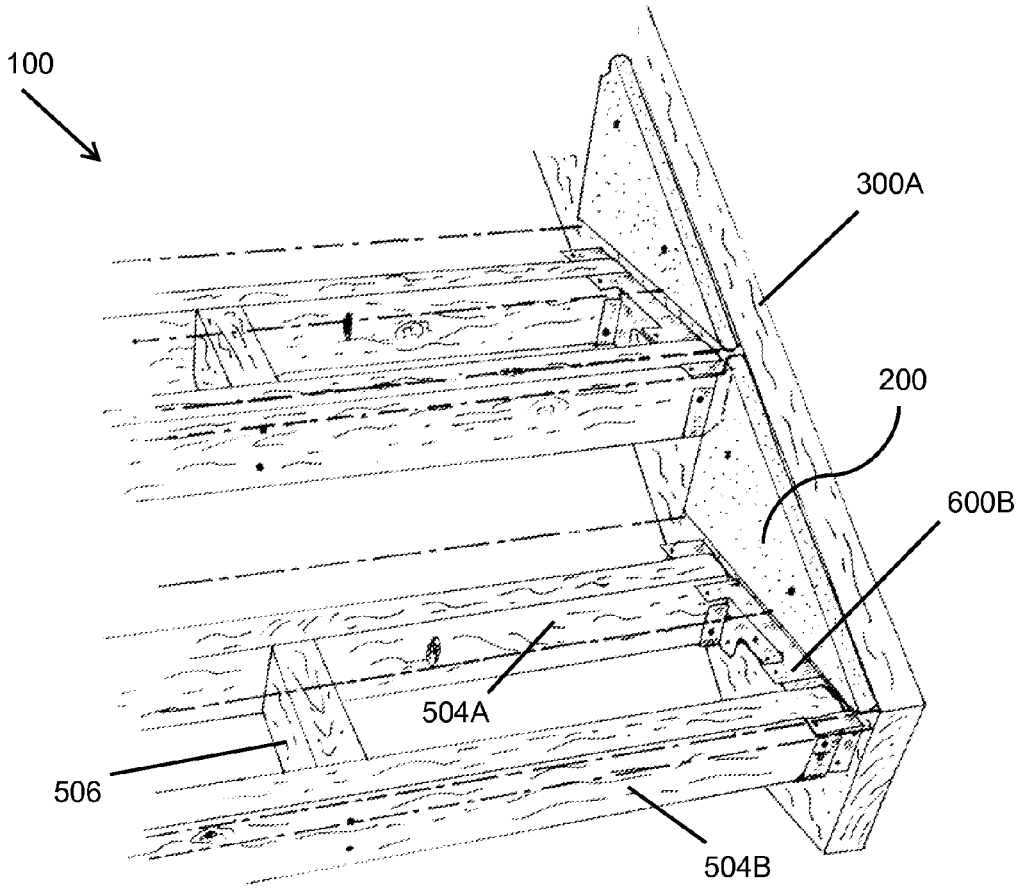
FIG. 8B illustrates the portion of the assembled stair unit of FIG. 8A with the tread planks removed.

After the stair unit 100 is completed and secured, the builder completes any necessary trim or fascia details. FIGS. 8A and 8B are perspective views of a portion of the stair unit 100 with the tread modules 500 secured between two stringers 300 (only one stringer is shown in the FIGs.). FIG. 8A illustrates the stair unit 100 with the tread planks 502 in place; FIG. 8B illustrates the stair unit 100 with the tread planks 502 transparent in order to show components that are otherwise concealed from view.

It should be noted that the brackets 600 may be used without the template triangles 200. The tread modules 500 may be laid out and installed using conventional methods such as a framing square. The brackets 600 solve many structural issues of stairs and materials, even without using the template triangles 200 for layout, cutting, fitting, and trimming. Similarly, the template triangles 200 and accompanying methods may be used without the brackets 600. For example, temporary template triangles 200 may be used in building a common wood stair, used for layout, cutting, and fitting, with traditional angled brackets, wood cleats, or other acceptable connection means.

Figure 13A:
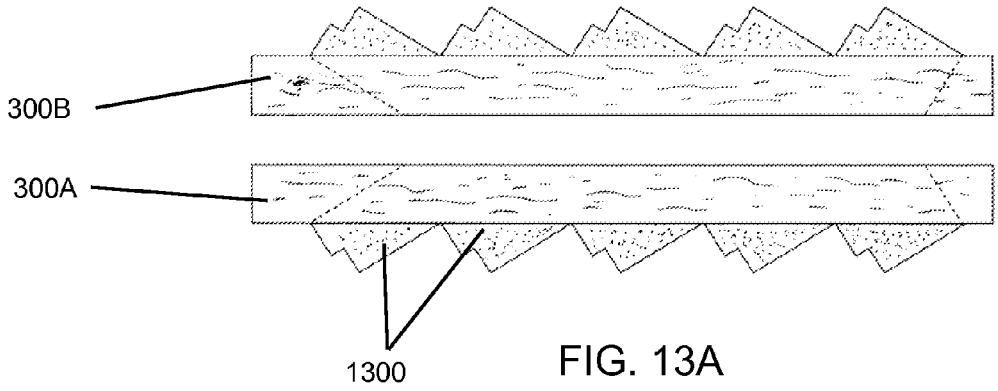
FIG. 13A illustrates a top view of notched structural triangles secured to stringers.
Figure 13B:
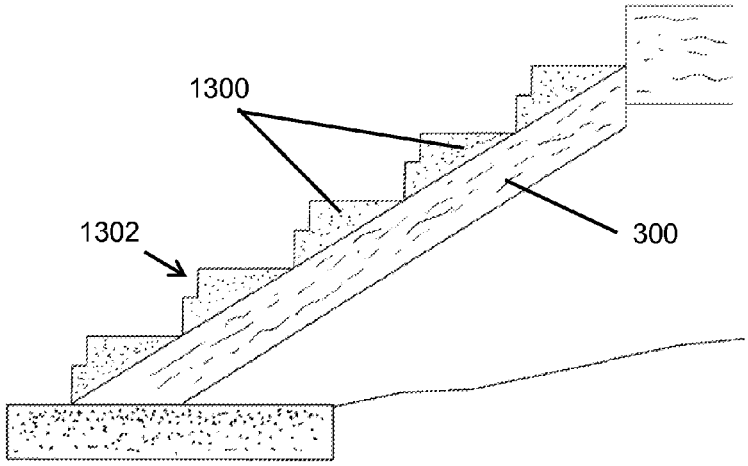
FIG. 13B illustrates a side view of a stringer, with notched structural triangles, secured to a perimeter joist.
Figure 14A:
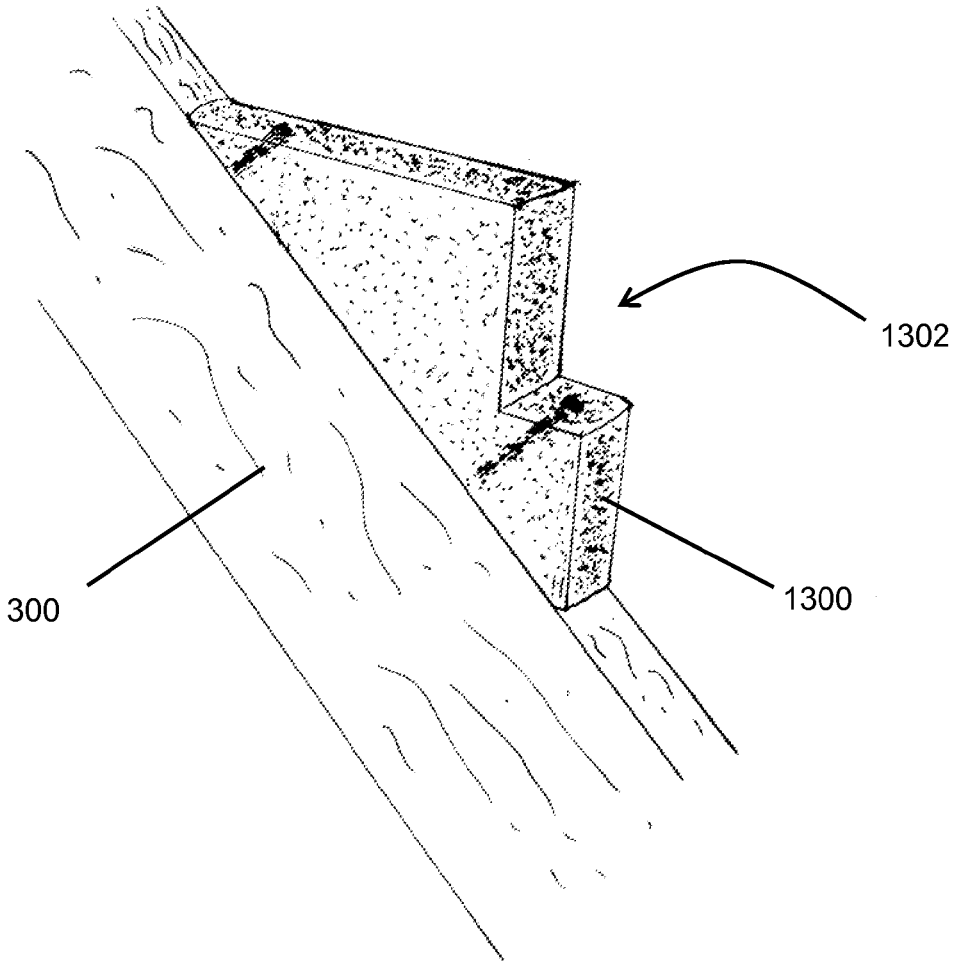
FIG. 14A illustrates a structural triangle secured to the top edge of a stringer.

In an alternative system, instead of using side-mounted template triangles, secured to the inside of a full stringer, such as a 2×12 or 2×10, structural triangle blocks may be cut from dimensional lumber or from adequate man-made material. As illustrated in FIGS. 13A, 13B and 14A, these structural triangles 1300 are secured to the top edges of the stringers 300. In this configuration, the wood stringers may not need to be as big because of the presence of the triangular blocks as structural members. For example, instead of using 2×12 dimension lumber for the stringers, 2×6 dimensional lumber may be used. Because no material is removed from a stringer, it retains its full rating and the combination of the smaller stringer and structural triangular blocks may be more structurally sound than a notched stringer having the same dimensions as the stringer/block combination.

Figure 14B:
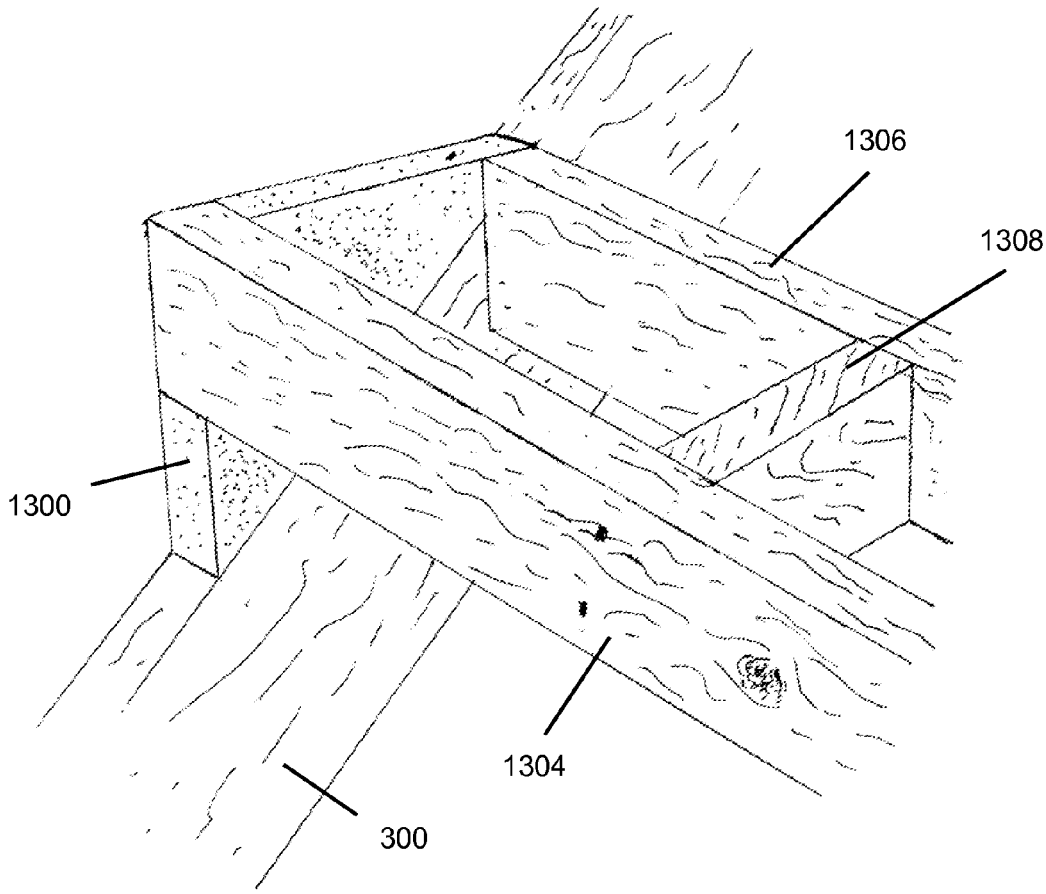
FIG. 14B illustrates a pair of joists secured to a stringer and structural triangle.

In one embodiment of the alternative system, a notch 1302 is cut or formed in what will be the front of each structural triangular block 1300 to accommodate a structural cross-member (joist) 1304 spanning the stringers (FIG. 14B). In this embodiment, the hypotenuse and angles of the structural triangular blocks 1300 are determined in the same manner as the side-mounted template triangles, and the structural triangles are positioned on the stringers 300 in the same places, as described above, where the top of each structural triangle 1300 is secured at the hypotenuse marks on the stringer 300.

The full hypotenuse of the structural triangle rests on the top edge of the stringer 300. After the structural triangular blocks 1300 have been secured to the stringers 300, the ends of the stringers 300 are cut to the correct lengths and angles with a similar method as described above, perpendicular and parallel to the structural triangular blocks 1300. The stringers 300 may then be secured to the perimeter joist of the deck or other structure. The ends of a front cross-member joist 1304 are placed in the notches 1302 of each set of opposing structural triangular blocks 1300 on the stringers 300 and secured to the structural triangular blocks 1300.

Figure 14C:
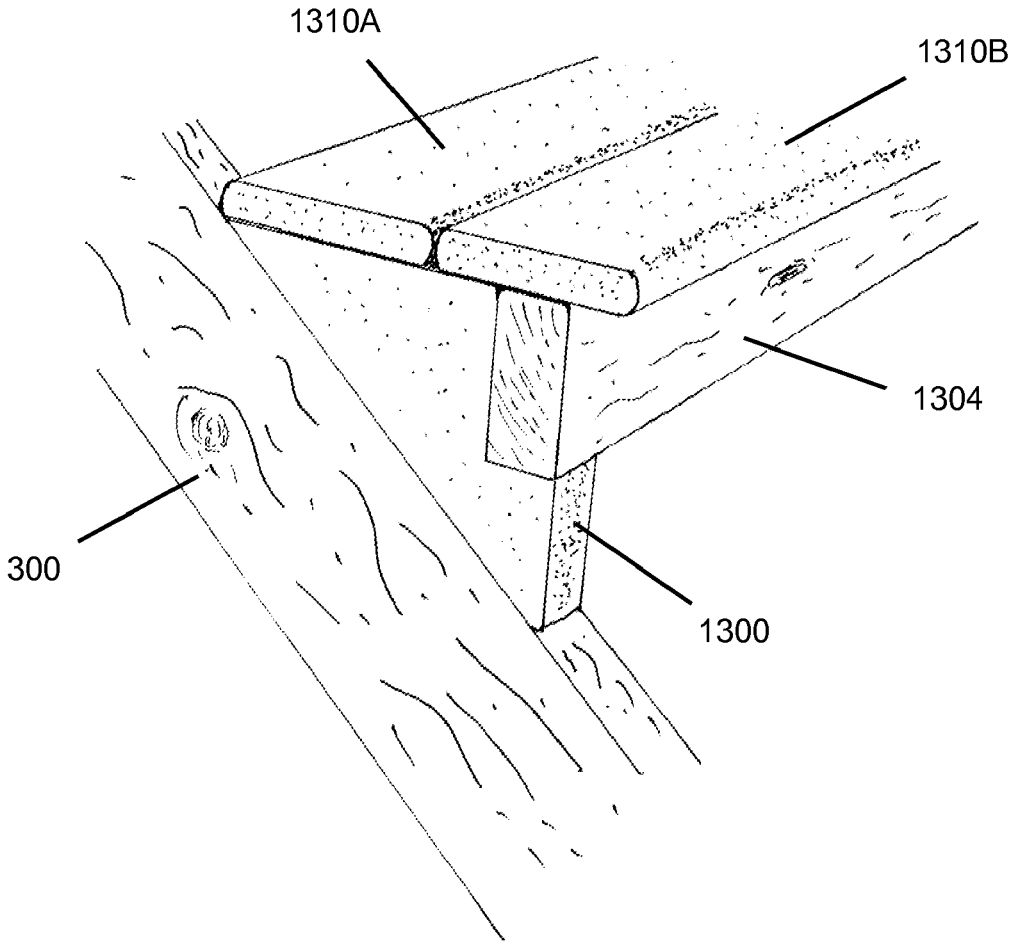
FIG. 14C illustrates a completed tread section using a structural triangle.

In this embodiment, the ends of a second joist are secured, such as with common brackets, to the insides of the stringers. For further structural support, cross blocking may be secured at regular intervals between the two joists for each tread. A tread plank is then laid across each of the two joists and secured to the joists (FIG. 14C). A builder may use as many of these stringer assemblies as needed to make the stair unit as wide as is desired. As with the system using the bracket, the span between each stringer is limited only by the structural ability of the joists because the tread planks are being supported continuously across the entire width of the stair unit.

With each embodiment, fascia or trim may be added to the front of the front joists and to the outsides of the stringers if desired.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. The described order of steps are indicative of but one embodiment of the presented process. Other steps and processes may be conceived that are equivalent in function or effect to one or more steps, or portions thereof, of the illustrated process. Additionally, the order in which a particular process occurs may or may not strictly adhere to the order of the corresponding steps shown.

What is claimed is:

1. A method for constructing a stair unit, comprising:

determining a number of treads and a rise and run of each tread;

determining a first angle ("horizontal angle"), a second angle ("vertical angle") and a hypotenuse of a right template triangle, the template triangle having a first side ("horizontal side") with a length equal to the run, a second side ("vertical side") with a length equal to the rise, the horizontal angle being the angle between the first side and the hypotenuse and the vertical angle being the angle between the second side and the hypotenuse;

cutting a pair of template triangles for each tread;

securing a first of each pair of template triangles to an inside surface of a first stringer with the hypotenuse of each template triangle parallel to and even with an upper edge of the first stringer and in line with the hypotenuse of an adjacent template triangle;

securing a second of each pair of template triangles to an inside surface of a second stringer with the hypotenuse of each template triangle parallel to and even with an upper edge of the second stringer and in line with the hypotenuse of an adjacent template triangle;

cutting a top end of both stringers whereby a back edge of each stringer will be parallel to a perimeter joist to which the stair unit is attachable;

cutting a bottom end of both stringers whereby a front edge of each stringer is be parallel to the back edge and a bottom edge of the bottom end is perpendicular to the front edge and substantially parallel to a lower landing surface; and securing a plurality of tread modules between the stringers, each tread module being in a one-to-one relationship with a corresponding pair of template triangles, a top surface of a tread plank of each tread module abutting a bottom edge of the horizontal side of the pair of template triangles, thereby forming the stair unit.

2. The method of claim 1, wherein cutting the template triangle comprises cutting a notch configured to receive an overhang by the tread plank.

3. The method of claim 2, wherein:

the vertical angle in degrees equals arctan (run/rise);

the horizontal angle in degrees equals 90-vertical angle; and the hypotenuse equals [1/sin(vertical angle)]*(run).

4. The method of claim 1, further comprising:

constructing each of the plurality of tread modules by:

securing a first of a pair of brackets across bottom surfaces of first and second tread planks at a first end of the tread planks and securing a second of the pair of brackets across the bottom surfaces of the first and second tread planks at a second end of the tread planks;

placing first ends of front and rear joists into a corresponding pair of U-shaped openings of the first of the pair of brackets and placing second ends of the front and rear joists into a pair of corresponding U-shaped openings of the second of the pair of brackets; and securing the first ends of the two joists to the first of the pair of brackets and securing the second ends of the two joists to the second of the pair of brackets; and securing the plurality of tread modules between the stringers by securing the first bracket to the inside of the first stringer and securing the second bracket to the inside of the second stringer, whereby the front and rear joists extend between the inside surfaces of the two stringers.

5. The method of claim 4, further comprising:

forming facing cutouts in the tread planks;

passing a handrail post through the cutouts in the tread planks and through a notch in the first of the pair of brackets;

securing the handrail post to the stringer through the first of the pair of brackets beneath the tread planks; and further securing the handrail post to the stringer through the template triangle above the tread planks.

6. A method for constructing a stair unit, comprising:

determining a number of treads and a rise and run of each tread;

determining a first angle ("horizontal angle"), a second angle ("vertical angle") and a hypotenuse of a right triangle ("structural triangle"), the template triangle having a first side ("horizontal side") with a length equal to the run, a second side ("vertical side") with a length equal to the rise, the horizontal angle being the angle between the first side and the hypotenuse and the vertical angle being the angle between the second side and the hypotenuse;

cutting a pair of structural triangles for each tread;

cutting a notch in the vertical side of each structural triangle configured to receive a joist;

securing a first of each pair of structural triangles to a top edge surface of a first stringer with the hypotenuse of each structural triangle against an upper edge of the first stringer and in line with the hypotenuse of an adjacent structural triangle;

securing a second of each pair of structural triangles to a top edge surface of a second stringer with the hypotenuse of each structural triangle against an upper edge of the second stringer and in line with the hypotenuse of an adjacent structural triangle;

cutting a top end of both stringers whereby a back edge of each stringer will be parallel to a perimeter joist to which the stair unit is attachable;

cutting a bottom end of both stringers whereby a front edge of each stringer is be parallel to the back edge and a bottom edge of the bottom end is perpendicular to the front edge and substantially parallel to a lower landing surface; and securing a set of front joists within the cut notches and extending between each set of opposing structural triangles on the stringers;

securing a set of rear joists between the inside surfaces of each set of opposing structural triangles on the stringers; and securing a tread plank to tops of each pair of front and rear joists.

7. The method of claim 6, wherein:

the vertical angle in degrees equals arctan (run/rise);

the horizontal angle in degrees equals 90-vertical angle; and the hypotenuse equals [1/sin(vertical angle)]*(run).

* * * * *